United States Patent [19]

Schaller et al.

[11] 4,341,254

[45] Jul. 27, 1982

[54] FRAME FOR A VENETIAN BLIND

[75] Inventors: Maurice Schaller, Clifton, N.J.; Victor Debs, Staten Island, N.Y.; Leo Abate, Wayne Township, Passaic County, N.J.; James Dodich, New Milford, N.J.; Regino Rodriguez, River Vale, N.J.; Joseph A. Anderle, Clifton, N.J.

[73] Assignee: Levolor Lorentzen, Inc., Lyndhurst, N.J.

[21] Appl. No.: 133,112

[22] Filed: Mar. 24, 1980

[51] Int. Cl.[3] ..... E06B 9/30; E06B 9/327

[52] U.S. Cl. ..... 160/172; 248/264; 160/178 B

[58] Field of Search ..... 160/166 R, 172, 173, 160/175, 178 B, 201, 182, 107, 34, 35; 248/264, 72; 52/656

[56] References Cited

U.S. PATENT DOCUMENTS

| | | | |
|---|---|---|---|
| 620,969 | 3/1899 | Roberts | 160/172 |
| 1,373,584 | 4/1921 | Armstrong | 160/201 |
| 1,992,148 | 2/1935 | Hammer | 160/178 B |
| 2,101,349 | 12/1937 | Sharp | 52/656 |
| 2,415,222 | 2/1947 | Spencer | 160/172 |
| 2,728,117 | 12/1955 | Zappone et al. | 160/182 X |
| 2,830,837 | 4/1958 | Falk | 160/182 X |
| 3,175,603 | 3/1965 | Tonnon | 160/107 |
| 3,203,468 | 8/1965 | Gossling et al. | 160/263 X |
| 3,918,513 | 7/1975 | England et al. | 160/176 R |
| 4,193,245 | 3/1980 | Johnson | 52/656 |
| 4,222,156 | 9/1980 | Anderle | 160/38 |

FOREIGN PATENT DOCUMENTS

| | | | |
|---|---|---|---|
| 612939 | 1/1961 | Canada | 160/182 |
| 1071196 | 3/1954 | France | 160/182 |
| 469472 | 4/1969 | Switzerland | 52/696 |

*Primary Examiner*—C. J. Husar
*Assistant Examiner*—Cherney S. Lieberman

[57] ABSTRACT

A venetian blind has a blind head and slats, brackets for supporting the blind head, and a frame having side channel members to receive the ends of the slats. Clip means connect both the bracket to window opening structure and to the side channel members.

4 Claims, 31 Drawing Figures

FRAME FOR A VENETIAN BLIND

BACKGROUND OF THE INVENTION

The present invention relates to a frame to be placed around a venetian blind, and more particularly to a frame for accentuating a venetian blind. The invention is also concerned with specific means for connecting portions of the frame to the venetian blind head and to the surrounding window structure, such as a window frame, window sill, wall, door, or the like.

Venetian blinds with arrangements that might be considered frames are known for instance from U.S. Pat. Nos. 3,192,991 issued July 6, 1965 to J. A. Anderle and 3,265,117 issued Aug. 9, 1966 to H. K. Lorentzen, et al. However, these frames are provided for entirely different purposes and are also structurally different and are related differently to the window structure.

It is an object of the present invention to provide a frame for a venetian blind which consists of a relatively small number of elements that can be combined to form an accent frame and that can be adapted to a variety of window structures as they exist in homes, offices, and the like.

It is another object of the present invention to provide an accentuating frame around a venetian blind which in addition to U-shaped channels for the sides only or the sides and the bottom of the frame, merely require one or two connecting clips for each side channel while all other elements easily fit together without any special connecting elements.

BRIEF DESCRIPTION OF THE DRAWING

The invention as illustrated by way of example in the attached drawings, in which.

DETAILED DESCRIPTION OF PREFERRED EMBODIMENTS

Figure 1:
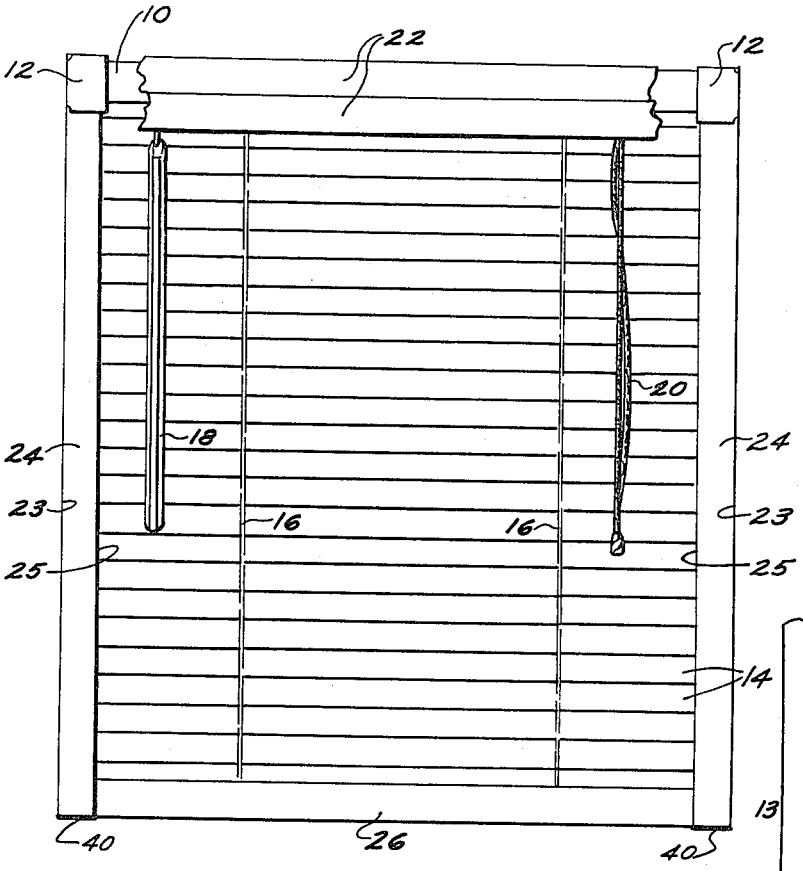
FIG. 1 is a front view of a venetian blind and of an accent frame for the venetian blind, said frame being designed in accordance with the present invention and including two side channels and a bottom channel.

Referring now to the drawings in detail, FIG. 1 shows a venetian blind of well-known type, with a venetian blind head 10 suspended in brackets 12 and having a number of slats 14 supported in ladders 16 in well-known manner. The venetian blind also comprises a wand 18 for tilting the slats 14 from open to closed position and vice versa and a lift cord 20 for selectively raising or lowering the slats 14. The venetian blind may also be provided with one or more valances 22 connected to venetian blind head 10 in customary manner.

The above-described well-known venetian blind, in accordance with the present invention, is combined with and surrounded by an accent frame or edging frame. This frame, in painted metal, such as steel or aluminum, has a number of components, including two side channels 24 and a bottom channel 26.

Figure 2:
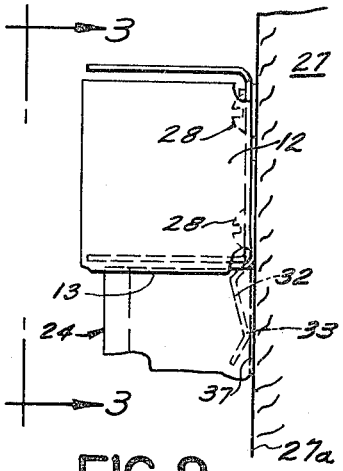
FIG. 2 shows the upper part of the frame adjacent the bracket for the venetian blind head, partly in section.
Figure 3:
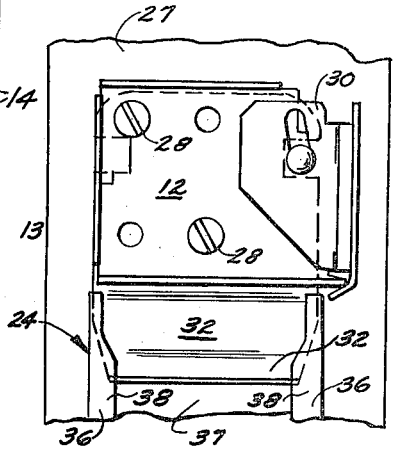
FIG. 3 is a view as seen in the direction of arrows 3—3 in FIG. 2.
Figure 5:
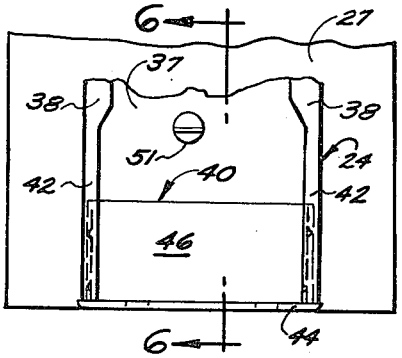
FIG. 5 shows a portion of the side channel adjacent the bottom end thereof.
Figure 6:
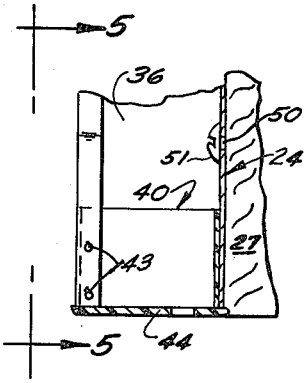
FIG. 6 is a section taken along the lines 6—6 of FIG. 5.
Figure 4:
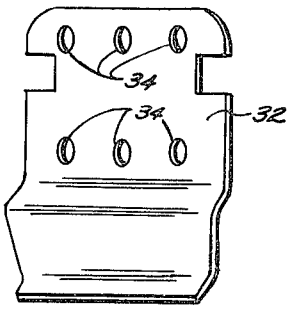
FIG. 4 is a perspective view of a clip forming part of the arrangement of FIGS. 2 and 3.
Figure 7:
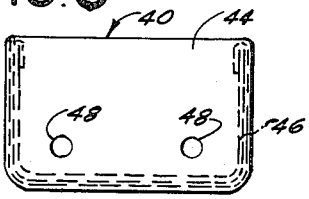
FIG. 7 is a bottom view of FIG. 5.

The brackets 12 (FIGS. 2 and 3) are connected to a window frame 27 by screws 28. In well-known manner bracket 12 is provided with a lid 30 which will permit insertion of the blind head 10 into brackets 12. A clip 32 is inserted between wall 27 and bracket 12 and is connected to the wall by the screws 28 passing through aligned bores 34 of clip 32 (FIG. 4). When assembling the frame, the side channel 24 is pushed from below between the window frame 27 and the clip 32 and is held by the clip against the window frame as shown in FIG. 2. To this end clip 32 is bent so as to resiliently urge the channel 24 against window frame 27 at 33.

The side channels 24 are basically of U-shaped cross-section with legs 36 and a connecting portion 37. The legs 36 of the U-shaped side channel have slightly inwardly extending flanges 38. There must, of course, be sufficient space left between the flanges 38 for up and down movement of the slats 14. The lower portion of the side channel 24 is closed by a cap 40 of plastic (FIGS. 5 to 7, and 22) which is held within the channel by crimping the inwardly protruding flanges 38, as shown at 42. Crimped portion 42 extends beyond cap 40 so as to permit rotation of bottom channel 26 when inserted into side channels 24, as will be explained in connection with FIGS. 24 to 28. Optionally, cap 40 may be connected to flanges 38 by dimpling flanges 38 with an appropriate tool as shown at 43.

The cap 40 has a bottom plate 44 and an upstanding substantially U-shaped wall 46. The bottom plate 44 may be provided with bores 48 for screws (not shown) in order to connect the cap, and consequently the side channel to a window sill, if desired. The cap protects an unwary passer-by from injury as it covers otherwise protruding sharp edges of metal channel. The bottom channel 26 will be described in greater detail further below in connection with FIGS. 23 to 30.

The accent frame, i.e. channels 24 and 26, and the elements connecting the same to the blind head and the window frame must be adapted to various conditions as they exist at the window frame opening or other opening, such as a door opening. For instance, the arrangement shown in FIGS. 1 to 7 suitable for connection to the inside of a window frame 27, i.e. where the outer edges 23 (FIG. 1) of side channels 24 are substantially flush with an edge 27*a* defining part of the window opening. In this instance, (FIGS. 5 and 6) the connecting portion 37 of side channel 24 adjacent the window frame may be provided with a bore 50 through which a screw 51 is passed to connect the side frame 24 to the window frame after the top of it has been inserted behind the clip 32 until it abuts or is close to the bracket 12 at 13 (FIG. 2). It is of course understood that other arrangements can be made. For instance, the side channels 24 could be connected to the window frame by means of an adhesive.

Figure 8:
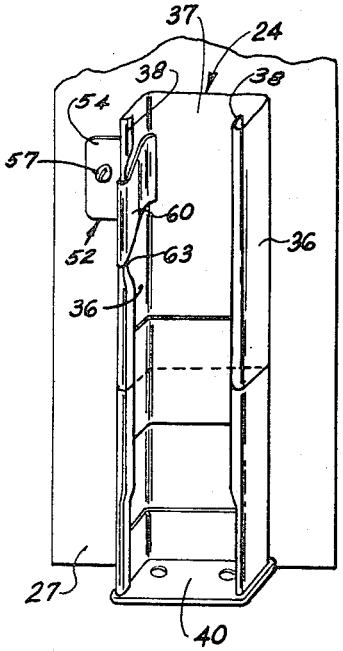
FIG. 8 is a perspective view of one side channel with an alternative clip for connection to a window frame.
Figure 17:
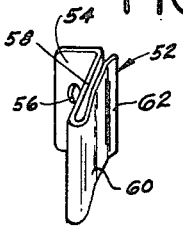
FIG. 17 is a perspective view of the clip appearing in FIG. 8.

Another arrangement is shown in FIG. 8, where there is sufficient space for the accent frame to be connected to the window frame 27 inside the window opening. In this case, the side channel 24 may be connected to the window frame by means of the special clip 52 (also shown in FIG. 17), which has an ear 54 with a bore 56 for a screw 57 by means of which clip 52 can be connected to the inside of the window frame 27. The clip also comprises two parallel portions 58 and 60, the latter having an end portion 62 slightly bent outwardly. Flange 38 is pinched or crimped at 63 where it is received between the portions 58 and 60 of clip 52.

FIG. 8 also illustrates another feature of the invention. For very high window openings the side channels could become too long for shipping purposes. In that case, channel 24 may be split into two or more parts. A U-shaped insert, splice or coupling 39 is placed inside the U-shaped side channels and inside the flanges of its legs to connect both parts. The legs of the insert are bent slightly inwardly for a friction fit to hold it in place making an inconspicuous splice. No pinching is required.

Figure 10:
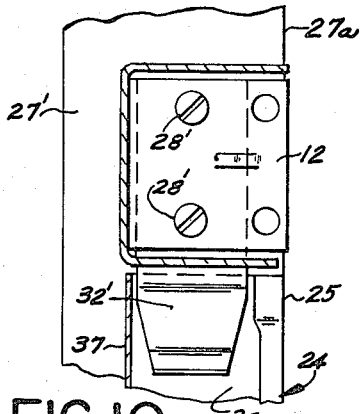
FIG. 10 is a section taken along the line 10—10 of FIG. 9.
Figure 9:
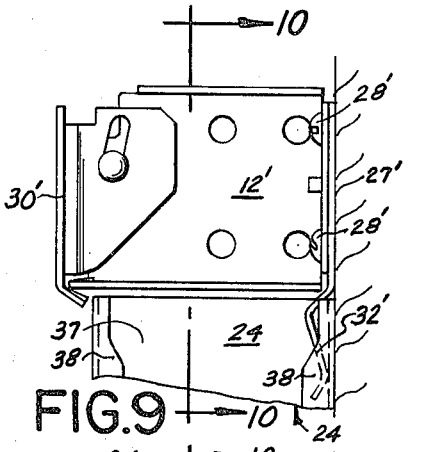
FIG. 9 is a view similar to that of FIG. 3 of an alternative arrangement.
Figure 18:
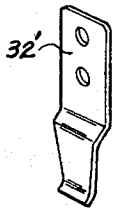
FIG. 18 is a perspective view of the clip used in the arrangement according to FIGS. 9 and 10.

FIGS. 9 and 10 show an embodiment of the accent frame according to the present invention in which the frame is connected to the outside of a window frame designated with the reference numeral 27′, i.e. where the entire accent frame is actually outside the window opening and where, for instance, the inside edges 25 of the side frames may extend along an edge 27*a* defining part of the window opening. The bracket 12′, which is similar to bracket 12 described in connection with FIGS. 2 and 3, and a clip 32′ (FIG. 18) are connected by screws 28′ to the outside of the window frame 27′. The side channel 24 is again pushed from underneath between clip 32′ and the window frame 27′, but this time the clip 32′ engages the legs 36 of frame 24 rather than the connecting portion 37.

Figure 12:
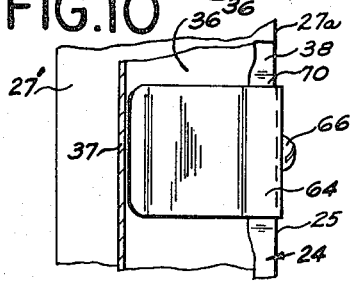
FIG. 12 is a section taken along the line 12—12 of FIG. 11.
Figure 11:
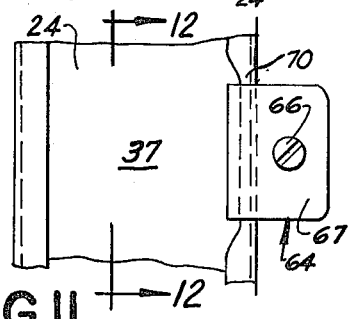
FIG. 11 shows a portion of one side channel with a modified clip for connecting the same to a window frame.
Figure 14:
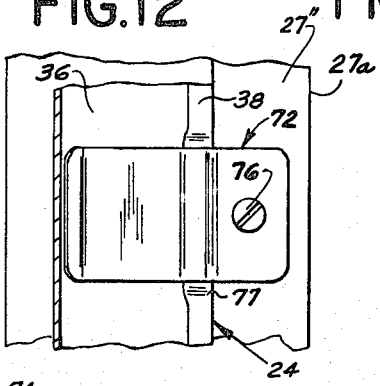
FIG. 14 is a section taken along the line 14—14 of FIG. 13.
Figure 13:
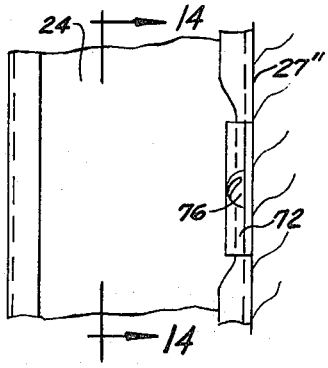
FIG. 13 shows a portion of one side channel with still another clip for connecting the same to a window frame.
Figure 19:
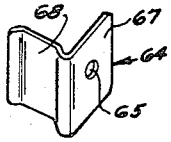
FIG. 19 is a perspective view of the clip used in the embodiment of FIGS. 11 and 12.
Figure 20:
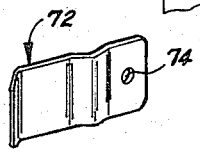
FIG. 20 is a perspective view of the clip used in the embodiment of FIGS. 13 and 14.

Between its top and bottom, the side channel 24 may be connected to the window frame by brackets or clips. Several such clips are shown in FIGS. 11 to 17 and 19 to 21. For instance, FIGS. 11, 12, and 19 show a clip 64 connected by a screw 66 passed through a bore 65 to the window frame 27′ while a portion 68 of clip 64 extending at right angles to a portion 67 of clip 64 engages the leg 36 at a pinched portion 70 of side channel 24.

Where the window frame (27) is wider, such as window frame 27″ of FIG. 14, i.e. the side channel 24 is spaced away from edge 27*a*, the clip may take the form of the clip 72 shown in FIGS. 13, 14 and 20, with a bore 74 for receiving therethrough a screw 76 by means of which the clip may be connected to the window frame 27″. Flange 38 is pinched at 77 so that it can be received and held between clip 72 and frame 27″.

Figure 21:
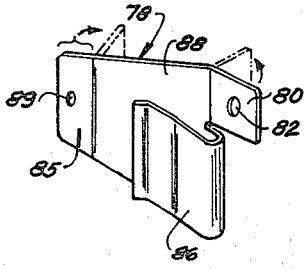
FIG. 21 is a perspective view of a clip that can be used in several different circumstances, for instance in the embodiment of FIGS. 15 and 16.
Figure 22:
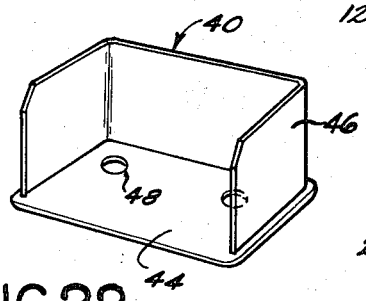
FIG. 22 is a perspective view of a bottom cap as shown in FIGS. 5 to 7.

A further clip 78 is shown in FIG. 21. Bracket or clip 78 has an ear 80 with a bore through which a screw 84 may be passed for connection to a window frame 27′. The bracket 78 includes a clip portion 86 so that the leg 36 of side channel 24 may be passed between the clip portion 86 and a portion 88 parallel thereto, at a pinched portion 87.

Clip 78 also has an ear 85 with a bore 89. Both ears may be bent or completely removed.

Figure 16:
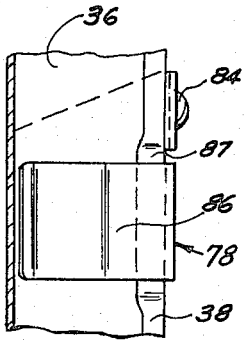
FIGS. 15 and 16 are similar to FIGS. 13 and 14, respectively, showing another type of clip for connecting the same to a window frame.
Figure 15:
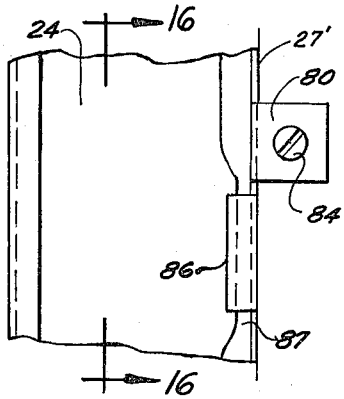

In the embodiment of FIGS. 15 and 16 clip or bracket 78 is used with ear 80 in the position shown in dotted lines in FIG. 21. However, there may be situations, such as when the side channel is to be spaced somewhat from the edge 27*a*, where the clip 78 is used with the ear 80 in the position shown in full in FIG. 21. Finally, there may be circumstances where ear 80 is not used at all and is simply removed and instead ear 85 with bore 89 is used, either as shown in full line or bent as shown in dash lines.

Clip 78 is provided in this form as a "universal" clip to be supplied with the accent frame where it is unknown in which window environment the frame is going to be mounted. Portion 88 may provide sufficient support in a situation where the side channel 24 is spaced somewhat in front of the window frame.

Figure 24:
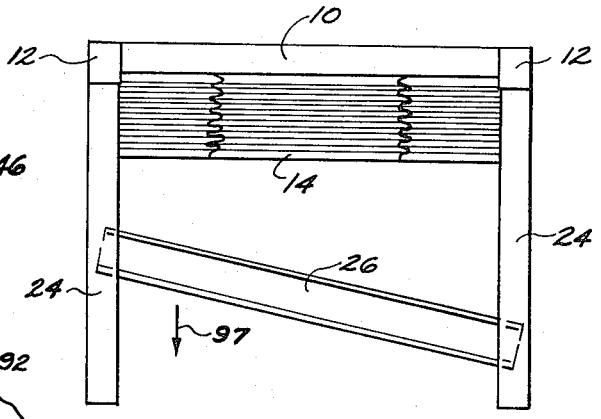
FIGS. 24 to 26 show successive steps of inserting the bottom channel into the side channels.
Figure 28:
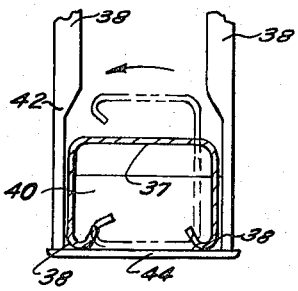

As mentioned above the accent frame may also include a bottom channel 26 which may be inserted between the legs 36 of the side channels 24, as illustrated in FIGS. 24 to 28. More specifically, the bottom channel 26 may be introduced at an oblique angle between the side channels 24, as shown in FIG. 24. It is then pushed downwardly on one side as indicated by the arrow 97 and rotated as indicated by the arrow 99 until it reaches the position shown in FIG. 26. The bottom channel 26 may be rotated either to the final position shown in FIG. 27, in which the connecting portion 37 rests against the bottom plate 44 of cap 40, or it may be rotated in the opposite direction as shown in FIG. 28 in which the connecting portion 37 forms the top of the bottom channel and where its flange portions 38 are adjacent the bottom plate 44 of cap 40. In this case the bottom channel serves as a sill for a bottom rail (not shown) of the blind.

Figure 23:
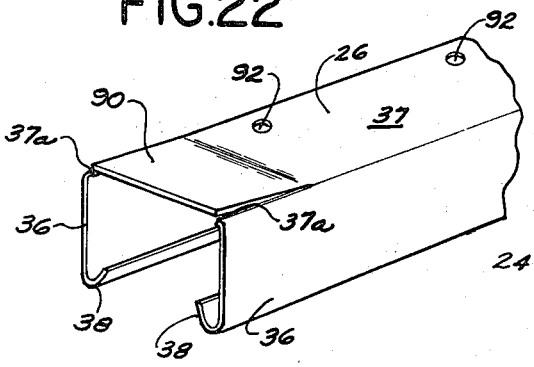
FIG. 23 is a bottom view of part of the bottom channel.
Figure 25:
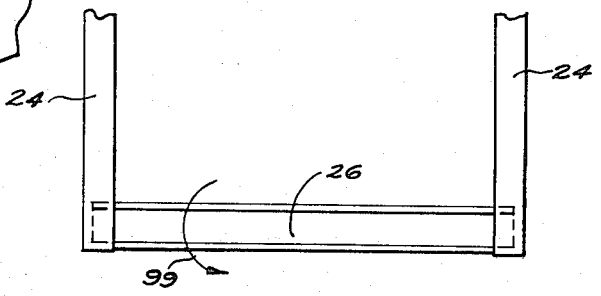
Figure 29:
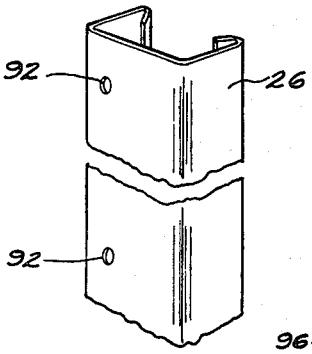
FIGS. 29 and 30 are two different embodiments of the bottom channel.
Figure 30:
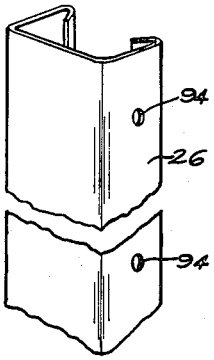
Figure 27:
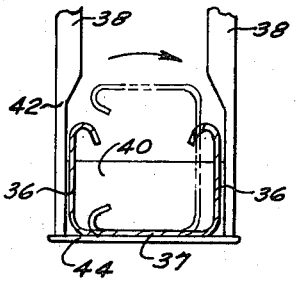
FIGS. 27 and 28 illustrate how the bottom channel can be rotated into its final position.

A modified version of the bottom channel 26 is shown in FIG. 23, in which slits 37*a* are cut at the ends of portion 37 so that a portion 90 is formed (only one being shown in FIG. 23). This permits flexing of the leg portions 36 inwardly at their ends to facilitate rotation within the lower portions of side channels 24. However, it should be understood that the bottom portion of channel 24 is flexible enough to permit rotation of bottom channel 26 even if the slits 37*a* are not provided. Crimped portions 42 extend high enough to permit rotation of channel 26. As shown in FIGS. 29 and 30, the bottom channel 26 may be provided with bores 92 or 94 respectively in appropriate places for connection to the window frame by screws.

Figure 31:
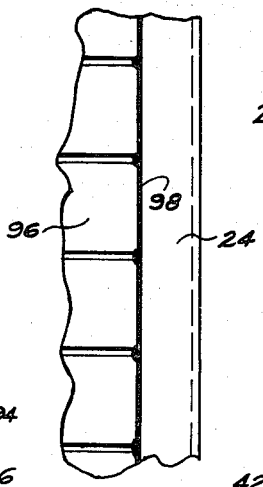
FIG. 31 is a partial side view of one side channel connected to a brick wall.
Figure 26:
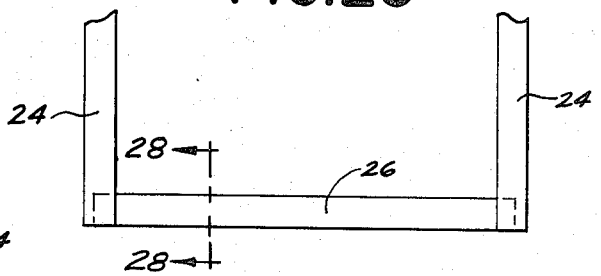

The side channels 24 and or bottom channel 26 may also be connected to the window frame by an adhesive as already mentioned above. It should also be kept in mind that it is not necessary to connect any of the frame parts 24 or 26 to a window frame. These parts could also be connected to a brick wall or similar structure as indicated in FIG. 31, where the side channels 24 are connected to bricks 96 by adhesive 98.

Also, according to the invention, the frame may comprise the side channels only with its connecting elements to a structure around a window opening or the like, without the bottom channel.

We claim:

1. For use in connection with a venetian blind having a blind head and slats suspended from said head: a pair of brackets supporting the blind head at opposite ends thereof at a window opening or the like, a frame surrounding the perimeter of at least part of said venetian blind, said frame comprising two substantially U-shaped side channels for respectively receiving opposite ends of said slats, and means for connecting said frame to said brackets and to a structure adjacent said opening, said connecting means including a pair of clips, each clip having a first portion for engagement with the respective bracket, and a second portion adapted to receive and hold in place a top portion of the respective side channel and for resiliently holding said channel against said structure, and fastening means for connecting said brackets and said first portions to said structure.

2. The combination according to claim 1, including a pair of caps for respectively closing the side channels at the ends thereof remote from said venetian blind head, each cap being made of synthetic material and having a substantially flat plate, and a U-shaped portion connected to said plate, and at least one bore through said plate for receiving fastening means therethrough for connecting said channel to said structure.

3. The combination according to claim 2, wherein said U-shaped portion substantially conforms to the inside of said side channel for reception therein.

4. The combination according to claim 3, wherein said cap is held within said side channel by inwardly pinched portions of said side channel.

* * * * *